United States Patent [19]

Ashton

[11] Patent Number: 4,660,623

[45] Date of Patent: Apr. 28, 1987

[54] CERAMIC SHELL MOULDS, MANUFACTURE AND USE

[76] Inventor: Michael C. Ashton, 195A Twentywell Lane, Sheffield S17 4QB, England

[21] Appl. No.: 571,241

[22] Filed: Jan. 16, 1984

[30] Foreign Application Priority Data

Jan. 21, 1983 [GB] United Kingdom ..... 8301616

[51] Int. Cl.[4] ..... B22C 1/02

[52] U.S. Cl. ..... 164/518

[58] Field of Search ..... 164/516, 517, 518, 519, 164/34, 35, 338.1, 361

[56] References Cited

U.S. PATENT DOCUMENTS

| | | | |
|---|---|---|---|
| 2,815,552 | 12/1957 | Turnbull . | |
| 2,820,265 | 1/1958 | Kohl et al. . | |
| 2,877,523 | 3/1959 | Turnbull . | |
| 3,018,528 | 1/1962 | Horton . | |
| 3,153,826 | 10/1964 | Horton . | |
| 3,259,949 | 7/1966 | Moore . | |
| 3,489,202 | 1/1970 | Taylor . | |
| 4,222,429 | 9/1980 | Kemp | 164/34 |
| 4,240,492 | 12/1980 | Edwards | 164/34 |
| 4,291,739 | 9/1981 | Baur | 169/5 |

FOREIGN PATENT DOCUMENTS

| | | | |
|---|---|---|---|
| 1431556 | 4/1965 | France . | |
| 1506852 | 12/1966 | France . | |
| 1540514 | 8/1967 | France . | |
| 7109500 | 12/1971 | France . | |
| 43-7526 | 1/1968 | Japan | 164/34 |
| 716121 | 9/1954 | United Kingdom . | |
| 1144130 | 3/1966 | United Kingdom . | |
| 1308958 | 3/1973 | United Kingdom . | |
| 1339001 | 11/1973 | United Kingdom . | |

OTHER PUBLICATIONS

Corning Glascoat Molds, written by Refractories Sales Dept., Corning Glass Works, Corning, N.Y.

*Primary Examiner*—Nicholas P. Godici
*Assistant Examiner*—G. M. Reid
*Attorney, Agent, or Firm*—Caesar, Rivise, Bernstein & Cohen, Ltd.

[57] ABSTRACT

A thin shell ceramic mould for use in metal casting is formed by applying a thin coating of a suitable material and binder to an expandable pattern, e.g. expanded polystyrene, having a density of about 30 to 50 kg/cu.m. The coated pattern is subjected to heat at a temperature of about 1000° C. for 10 minutes to burn out the pattern and cure the coating. The ceramic shell is made just thick enough to be handled.

16 Claims, No Drawings

CERAMIC SHELL MOULDS, MANUFACTURE AND USE

This invention relates to a shell mould in which the mould wall is formed of a ceramic material, i.e. a so-called ceramic shell mould. A ceramic shell mould is useful in the casting of molten metals.

It is well known to make a mould by applying a refractory coating to an expendable combustible pattern, placing the coated pattern in unbonded sand in a casting box and while using the sand to support the refractory coating, removing the expendable pattern. The expendable pattern is destroyed by being burned away by the incoming molten metal. This technique is known as the "Full Mould Process" and while it has many advantages it also has limitations in particular, a serious degree of unreliability. For example, it is not always possible to ensure complete removal by combustion of the expendable pattern and residues could contaminate the casting, especially when made of a low carbon stainless steel or a low alloy steel. The Full Mould Process is exemplified by British Pat. No. 1007067 (Monsanto), U.S Pat. No. 2,930,343 (Shroyer), U.S. Pat. No. 3,259,949 (Moore), U.S. Pat. No. 4,222,429 (Kemp), U.S. Pat. No. 4,291,739 (Baur) and our European patent publication No. 0052997A1.

It is known in one version of the lost wax investment casting technique to form an empty ceramic shell mould and sometimes place that in a casting box. This technique involves the manufacture of a mould using expendable patterns of solid material which are destroyed by shock heating leaving an empty ceramic shell mould which may be cast unsupported or subsequently placed in a supporting bed of refractory material in a casting box. Such a ceramic shell mould is usually made by first forming patterns of a predetermined size and shape and these are joined to a gating system to form a pattern assembly, referred to herein as "the pattern". The pattern is made of a solid meltable material, typically wax. A slurry of refractory materials and binder is applied, followed by a stucco to form a coating of the pattern. The coating formed is allowed to dry and harden depending on the binding system used, and this step can take up to a day or more. Several coatings are applied. Because the shell mould is subjected to crack-inducing expansion stresses when the solid pattern material is later destroyed by heating, the coating and hardening step are repeated to build up a layer of coatings sufficiently thick to withstand such stresses. After the mould wall has been built up to an adequate thickness and allowed to dry and harden, the solid pattern is removed by shock heating the coated pattern in a suitable chamber, for example the coated pattern is subjected to autoclaving in a steam chamber. As the solid melts it tends to expand and this increase in volume is a factor in building up crack-generating stresses in the layer. The melted solid may be recovered for reuse. The substantially empty shell is then fired at about 1000° C. for a suitable period, e.g. an hour, to remove completely all traces of the pattern and fully to harden the shell. Molten metal can be cast into the hot mould after a short interval but where the article to be cast is of relatively thicker section the mould is allowed to cool to a lower temperature for metallurgical reasons. If vacuum casting is to be used, the fired mould is first allowed to cool to room temperature for visual inspection and possible cleaning; it is then embedded in refractory material and preheated before casting takes place.

It has been proposed in French Pat. No. 1431556 to form the pattern of a cellular material e.g. expanded polystyrene. It is also known from French Pat. No. 1540514 to remove such a pattern by heating in stages over a prolonged period.

We have now discovered that if a coated combustible pattern of certain materials is used and this is shock heated to the temperature at which the shell is hardened, the pattern is removed and the shell is hardened simultaneously and the only factor determining the thickness of the shell wall is the requirement for handleability. There is thus no need to build up the shell wall to the thicknesses required to withstand the tendency to cracking which is liable to occur during the removal of the patterns made from solid material. This invention offers other advantages and benefits in terms of both the manufacture and use of the shell and these will be apparent from the following description.

According to one aspect of this invention there is provided a method of making a ceramic shell mould for subsequent placement in a body of particulate material for casting a metal article, the method comprising forming a combustible pattern of cellular plastic material corresponding in shape and size to the article to be cast, applying a hardenable coating of refractory material and removing the pattern characterised by forming on the pattern only a thin layer of coating and subjecting the coated pattern having the thin layer to the rapid application of heat at substantially the same temperature at which the coating is hardened thereby to remove the pattern and leave a readily handleable hardened shell.

According to another aspect of this invention, there is provided a method of making a ceramic shell mould for subsequent placement in a body of particulate material for casting a metal article, the method comprising forming a combustible pattern of cellular plastic material corresponding in shape and size to the article to be cast, applying a hardenable coating of refractory material and removing the pattern characterised by:

(i) applying the coating to the pattern to form a layer which is the minimum thickness required for handleability, and (ii) subjecting the coated pattern to heat at the temperature required to harden the coating and remove the pattern- and leave a readily handleable hardened shell.

It is preferred to transfer the coated pattern rapidly after coating to a chamber at about 800° C. to 1100° C. At that temperature the cellular material vaporises and the shell wall is fully hardened to a ceramic shell. The minimum temperature and degree of shock heating to cure and harden the ceramic shell without generating crack inducing stresses during destruction of the pattern will depend on the materials of which it is formed. The temperature of the hot environment for this may range from 900° C. to 1100° C. Our evaluations have shown that it is much preferred to place the coated pattern at ambient temperature in a furnace heated to about 1000° C. for a period of 5 to 15 minutes during which time the pattern is removed and the required high mould strength is developed.

Most preferably the cellular plastic material is expanded polystyrene or expanded polyurethane or the like. When such a material is rapidly heated, the material tends to vaporise and expand but crack inducing stresses are low and short lived and collapse soon follows.

According to another aspect of the invention there is provided a method of making a ceramic shell mould for the purpose described, the method comprising:

(i) forming a pattern of a cellular combustible material corresponding in shape and size to the article to be cast, (ii) applying to the formed pattern a slurry of refractory material and binder and a stucco to deposit thereon a coating and allowing or causing the coating to harden sufficient to permit the application of another coating, the coating step being performed only one or a few times so as to deposit on the pattern the minimum thickness appropriate to the handleability of the shell and the size of the pattern, and (iii) subjecting the coated pattern to rapid heating at the temperature required to remove the pattern material and to harden the coating to form the ceramic shell.

According to yet another aspect of this invention there is provided a method of making a ceramic shell mould for the purpose described, characterised by (i) forming a pattern of expanded polystyrene corresponding in shape and size to the article to be cast, (ii) applying to the expanded polystyrene pattern a slurry of refractory material and binder followed by a stucco to deposit thereon a coating and causing or allowing the coating to harden sufficient to permit the application of another coating, the coating step being performed only one or a few times so as to deposit on the pattern the minimum thickness appropriate to the handleability of the shell and the size of the pattern and without regard to the risk of damage to the shell during the subsequent heating stage or in the use of the formed shell in casting molten metal, (iii) rapidly heating the coated pattern at a temperature required to remove the expanded polystyrene and simultaneously to harden the coating to form the thin ceramic shell, and (iv) allowing the thin ceramic shell to cool.

The cellular material from which the pattern is formed is preferably relatively rigid. We prefer to use a cellular material having a density of about 30 to about 50 kgm/cu.m since such material is sufficiently rigid to resist deformation and so is dimensionally more accurate than the lower density cellular material used in a Full Mould Process of our European Patent Application 81.305437.6. It is possible to apply the coating direct to the form of cellular material but it is possible first also to apply an extra lining on the cellular material for example to improve the surface finish of the inner surface of the shell. The lining may be made of a thin lining of wax, a wash or the like and the presence of the lining may need to be taken into account when dimensioning the pattern.

The slurry is preferably based on ethyl silicate or like binder. The choice of binder will determine whether the coating is only hardened by drying or is chemically hardened. The refractory material in the slurry may be selected from the wide range of materials available. The slurry may be applied to the pattern by dipping, spraying, overpouring or the like and the stucco may be applied by raining or immersing in a fluidised bed. In general, to form the thin shell mould of this invention one, two or three coating treatments will suffice, a marked reduction compared with the number of coatings necessary when patterns made from solid pattern materials. The number of coatings required in this invention will be related to the size and shape of the pattern.

The ceramic shell mould may have a wall thickness ranging from as little as 2 mm up to, say, 4 mm which will vary according to the shape and size of the article to be cast. Even a 2 mm wall thick empty ceramic shell of this invention can be handled without damage in the rough conditions of a foundry, between the firing stage and being embedded in the supporting material, typically sand. It is a surprising feature of this invention that a thin ceramic shell mould can be made even for casting an article which is relatively large or heavy. When a large pattern is made of a solid material based on wax or urea, the pattern tends to flex under its own weight and so distort or crack the shell but this tendency does not apply to a ceramic shell mould of this invention because a lightweight cellular material with little or no tendency to sag is used to form the large pattern. In particular the thin shell mould of this invention can be used to make large and heavy article castings with such thick sections that could not be made easily or at all by the conventional lost wax process. Because of the use of cellular plastics materials as the pattern, one can make ceramic shell moulds of large size and thick sections. Despite their size the shells formed are of extreme lightweight, adequately rigid and dimensionally accurate.

According to yet another aspect of this invention there is provided for use in casting metal, an empty ceramic shell mould characterised by a thin wall say up to 4 mm thick and being strong enough to be handleable.

The ceramic shell mould of this invention may be used in the casting of molten metals in a casting box using a variety of known techniques. The thin ceramic shell of this invention may be used when cool although where there is a risk of severe chilling some preheating may be done. It is preferred to carry out casting using the technique of our application No. 81.305437.6 (my ref:3618 for the REPLICAST technique).

According to another aspect of this invention there is provided a method of casting an article using a thin ceramic shell mould as defined above characterised by:

(i) placing the thin ceramic shell mould in a casting box, (ii) surrounding the ceramic shell mould with a body of loose particulate material and compacting the material by high frequency low amplitude vibration so as to maximise the density of the material in contact with the ceramic shell mould thereby minimising distortion or other damage of the ceramic shell mould during the casting of molten metal.

According to yet another aspect of this invention there is provided a method of casting an article using a thin ceramic shell mould as defined above comprising:

(i) placing the thin ceramic shell mould in a casting box having access ports for the application of a vacuum, (ii) surrounding the thin ceramic shell mould with a body of loose particulate material, (iii) compacting the particulate material by high frequency low amplitude vibration so as to maximise the density of the material in contact with the thin ceramic shell mould, thereby minimising distortion or other damage of the thin ceramic shell mould during casting, (iv) optionally, applying a cover of air-tight material to the top of the box, (v) optionally, applying a vacuum from just before the casting to initial solidification of the metal, and (vi) casting molten metal into the ceramic shell mould to form the desired article.

A feature of the method of casting is the deliberate compaction of the particulate material in a predetermined way and to a predetermined degree. The purpose of compaction is twofold, firstly to cause the particulate material to flow into intimate contact with the surface of the thin shell mould irrespective of its contours and secondly to compact the mass of the material by bringing the individual particles in close contact, ideally until they can be brought no closer together. One way of determining the degree of compaction is by measuring the bulk density of the material used and subjecting the material to compaction so as to maximise the bulk density where it contacts the thin ceramic shell mould. High frequency low amplitude vibration is preferred and the force rating of the vibrator is preferably of the order of 0.75 of the total load it is vibrating, giving the casting box an acceleration of about 1.5 g. A frequency of at least 40 Hertz is preferred to cause the material to flow about complexly shaped thin ceramic shell moulds. Vibration can be performed by a vibrator attached to the side of the box; preferably the box is mounted on a vibrating table since vibration is more uniform. Both electric and air vibrators are suitable. Maximum consolidation appears to be achieved in a short time, between 30 and 60 seconds, depending upon ceramic shell mould complexity, and this may be detected visually by the fall in level of the particulate material in the box and then the presence of a shimmer or rolling of the top surface of the particulate material, which shimmer or rolling is constant. It must be stressed that the purpose of compaction is to bring the particles together, not to evacuate air between the particles, and for this reason the application of a vacuum alone does not produce compaction for the purpose of this invention.

The top of the box may be covered or open to the atmosphere: in the former case there is a substantially uniform head of pressure through the compacted particulate material whereas in the latter case there is a pressure gradient through the height of the compacted material and the system is dynamic. Where an air impermeable cover is placed on the box, it is possible to place the thin ceramic shell mould less deep in the particulate material. When the bed is overlaid with a sheet of impervious material, very little air is drawn in through the bed or the ceramic shell mould and a high uniform degree of vacuum may be established in the bed material giving considerable-support to the thin ceramic shell mould. The vacuum may be drawn using a medium pressure vacuum pump, preferably a liquid ring pump. The rate of application of vacuum will depend on the permeability of the particulate material and the power of the vacuum pump being used. The vacuum must be drawn from the bottom of the box where the top of the box is open to the atmosphere; where the top of the box is covered with an air-tight sheet, the vacuum may be drawn from the sides of the box or from the bottom or through the cover itself. It is desirable to cover the open ceramic shell mould with a plastics film or the like to prevent ingress of particulate material into the mould and to maintain the vacuum in the body of particulate material.

Where the method is performed using the option of drawing a vacuum, the level of vacuum needed will be related inter alia to the degree of compaction of the particulate material and its gas permeability, and the metal being cast. The vacuum removes any gases from the mould. In addition the vacuum reduces the pressure of air contained in the voids between the grains and so increases the frictional force between them. In this way the body of the compacted particulate material is held together to resist any tendency of the thin ceramic shell mould to deform.

The vacuum can be established in a matter of seconds before it is wished to pour the molten metal. The vacuum pressure can be measured by means of a probe gauge inserted into the body of the particulate material. The vacuum should be maintained following casting until the cast metal has started to solidify to the point at which it will not distort or is self supporting. This will depend on the size of the casting: in the case of a small casting the vacuum may be removed two to three minutes following casting and for a large body the period may be five to ten minutes following casting.

The particulate material is preferably a sand but may be grit, gravel, steel shot or the like. The particulate material must be sufficiently fine to support the thin shell mould and sufficiently coarse to allow the removal of gaseous products. Commercial sands (e.g. Chelford 50 available in Great Britain) are suitable. The material will dictate the level of vacuum that can be achieved for a given flow rate of air. This is directly related to the permeability which is related to grain fineness and shape. It is preferred that where sand is used, the grains be rounded or sub-angular since such grains can flow and compact better under vibration.

In another method of casting, the shell is placed in a fluidised bed of the particulate material and the bed is collapsed and vibrated as described.

The invention may be applied to a variety of metals, both ferrous and non-ferrous. The article to be cast may weigh in excess of 25 kg and up to several tonnes and may be of complex shape. It has been discovered that the thin ceramic shell moulds of this invention may be used to good purpose even when casting metals which expand on solidification, e.g. ductile iron of high carbon equivalent. This is another surprising advantage of this invention.

The invention is illustrated by the following Examples.

EXAMPLE 1

A slurry of density 1.68 was made up by mixing 12.5 kg of −200 grade Molochite flour with 6 liters of an ethyl silicate binder. Isopropyl alcohol was added to adjust the specific gravity to 1.7 g/cu.cm. (MOLOCHITE is a trade mark).

A pattern was moulded from expanded polystyrene density about 40 g/cu.cm, to the shape of a 5.08 cm plug valve. A coating of the slurry was applied to the pattern by overpouring. A stucco of Molochite grog (−16 to +30 mesh) was then applied. The coated pattern was then partially hardened in a cabinet containing ammoniated air. The process was repeated twice only. The layer formed by the three coating steps was measured and found to have an average thickness of 3.1 mm and a range of from 2.3 mm to 3.8 mm.

A furnace was heated to about 800° C. The coated pattern was placed in the furnace. The expanded polystyrene foam within the coated pattern vaporised and was removed without damaging the layer which was left as a ceramic shell. The layer hardened at this temperature. The hardened shell was removed after about 10 minutes and allowed to cool. When required, the thin ceramic shell mould was placed in a casting box and used to cast an article of low carbon steel using the techniques of European patent application No.

81.305437.6 (my ref: 3618, for the REPLICAST technique).

By way of comparison, a ceramic shell mould was made using the conventional solid wax pattern material. It was necessary to invest the wax pattern with eight coats leading to a shell thickness of about 7.5 to 8 mm. The manufacturing process took much longer and was very labour intensive. The pattern was heated to two temperatures, a lower one to remove the bulk of the wax by melting and draining and then a higher one to remove residual wax in the pores of the mould and develop higher strength by sintering. The hot ceramic shell mould was immediately transferred to the casting station to receive molten steel. The manufacturing process needed more labour, time and materials and was generally inconvenient.

EXAMPLE 2

Different types of articles were cast using the ceramic shell mould of the invention. In each case the weight of finished casting, weight of metal poured and characteristics of the mould were noted. The "sand:finished casting" ratio was noted. The details are reported in the Table from which it will be seen that this ratio is an average of about 0.15:1. When casting metal articles using a bonded sand, the foundry would expect the ratio to be about 6:1. When using a resin shell mould the ratio would be about 2:1. In the lost wax process the ratio would be about 1:1 and it would be unusual to use that process to try to cast an article weighing more than about 25 kg. In the case of this invention not only is the ratic the lowest of all, but these results show that one can cast articles weighing over 50 kg. Other data indicates that one can use a ceramic shell mould of this invention to cast articles weighing in excess of 200 kg.

TABLE

| Article Cast | | | Ceramic Shell Mould | | | |
|---|---|---|---|---|---|---|
| Item | finished weight (kg) | Metal poured (kg) | thickness (mm) | coatings | weight (kg) | "sand:finished weight" ratio |
| Sandwich valve | 2 | 4 | 3 | 3 | 0.6 | 0.30:1 |
| ground engaging tool | 4 | 6 | 3 | 3 | 0.7 | 0.17:1 |
| track link | 4 | 6 | 3 | 3 | 1.0 | 0.25:1 |
| alternator claw | 4 | 7 | 3 | 3 | 0.7 | 0.17:1 |
| pin joint | 6 | 12 | 3 | 3 | 1.0 | 0.16:1 |
| plug valve (5 cm bore) | 18 | 30 | 3 | 3 | 3.1 | 0.17:1 |
| ball valve (7.2 cm bore) | 19 | 39 | 4 | 4 | 3.4 | 0.18:1 |
| ball valve (11 cm bore) | 43 | 79 | 4 | 4 | 6.6 | 0.15:1 |
| gate valve (15 cm bore) | 57 | 90 | 4 | 4 | 9.4 | 0.16:1 |

I claim:

1. A method of making a ceramic shell mould for use in casting a metal article, the method comprising forming a combustible pattern of cellular plastic material corresponding in shape and size to the article to be cast, applying only a thin layer of coating of refractory material and removing the pattern and hardening the layer of coating by the step of rapidly heating the cellular plastic material and coating to a temperature of about 800° C. to 1100° C. for a period of about 5 to 15 minutes to thereby form a readily handleable hardened shell mould.

2. A method according to claim 1, including applying the coating to the pattern to form a layer which is the minimum thickness required for handleability during the removal of the pattern and during subsequent casting.

3. A method according to claim 1 wherein the step of applying only a thin layer of coating of refractory material is carried out by applying a slurry of refractory material and binder and a stucco one or more times to the formed pattern, and, between applications, allowing or causing the coating to harden sufficiently to permit the application of another coating.

4. A method according to claim 3, comprising the steps of forming the pattern of expanded polystyrene.

5. A method according to claim 3, in which the coating is formed of a slurry based on an ethyl silicate binder.

6. A method according to claim 1, in which the coated pattern is heated rapidly at about 1000° C.

7. A method according to claim 1, in which the pattern comprises a cellular material having a density of from 30 to 50 kgm/cu.meter.

8. A method according to claim 1, in which the pattern is coated sufficient times to form a layer of from 2 to 4 mm thick.

9. A method according to claim 1, including shaping the pattern to cast an article to have a section thickness exceeding 1.5 cm and/or a weight in excess of 25 kgm.

10. A method of making a ceramic shell mould and casting a metal article therein, comprising the steps of:

(i) forming a combustible pattern of cellular plastic material corresponding in shape and size to the article to be cast, (ii) applying only a thin layer of coating of refractory material to said pattern, (iii) removing the pattern and hardening the shell by the step of rapidly heating the cellular plastic material and coating at a temperature of about 800° C. to 1100° C. for a period of about 5 to 15 minutes to form a readily handleable hardened shell ceramic mould, (iv) placing the ceramic shell mould in a casting box, (v) surrounding the ceramic shell mould with loose particulate material and compacting the material by high frequency low amplitude vibration so as to maximize the density of the material in contact with the ceramic shell mould thereby minimizing distortion or other damage of the ceramic shell mould during the casting of molten metal in the casing box, and (vi) pouring molten metal into the ceramic shell mould to form the desired article.

11. A method according to claim 10 wherein the casting box includes access ports for the application of a vacuum, comprising the steps of:

(i) applying a cover of air-tight material to the top of the casting box, (ii) applying a vacuum through the access ports from just before the casting.

12. A method according to claim 11, wherein the molten metal is selected from the group consisting of ferrous metals and alloys and non-ferrous metals and alloys and metals and alloys which expand upon solidification.

13. A method according to claim 10, wherein the molten metal is selected from the group consisting of ferrous metals and alloys and non-ferrous metals and alloys and metals and alloys which expand on solidification.

14. A method according to claim 10, wherein the molten metal is selected from the group consisting of ferrous metals and alloys and non-ferrous metals and alloys and metals and alloys which expand upon solidification.

15. A method according to claim 10 wherein the bottom of the casting box includes access ports for the application of a vacuum, comprising the steps of;

(i) placing the thin ceramic shell mould in the casting box, (ii) surrounding the thin ceramic shell mould with a body of loose particulate material, (iii) compacting the particulate material by high frequency low amplitude vibration so as to maximise the density of the material in contact with the thin ceramic shell mould, thereby minimising distortion or other damage of the thin ceramic shell mould during casting, (iv) leaving the top of the box open to the atmosphere, (v) applying a vacumm through the access ports from the bottom of the box from just before casting.

16. In the art of forming a ceramic shell mould for use in casting a metal article, the mould being formed by making a consumable pattern of predetermined size and shape, applying a slurry of refractory materials and binder to form a coating and repeating the application to build up a layer of sufficient thickness to resist the crack-inducing expansion stresses when the pattern is destroyed by heating, the improvement comprising the steps of:

(i) forming the pattern of a cellular plastic material having a density of about 30 to about 50 kgm/cu.m, (ii) building up the layer to a thickness of from about 2 mm to about 4 mm only, and (iii) removing the pattern and hardening the layer by the step of rapidly heating the cellular plastic material and coating at a temperature of from about 800° C. to about 1100° C. for about 5 to 15 minutes.

* * * * *